US009974405B1

(12) United States Patent
Conlin

(10) Patent No.: US 9,974,405 B1
(45) Date of Patent: May 22, 2018

(54) ADJUSTABLE CHRISTMAS TREE

(71) Applicant: Thomas Conlin, Spring Hill, FL (US)

(72) Inventor: Thomas Conlin, Spring Hill, FL (US)

( * ) Notice: Subject to any disclaimer, the term of this patent is extended or adjusted under 35 U.S.C. 154(b) by 379 days.

(21) Appl. No.: 14/798,768

(22) Filed: Jul. 14, 2015

(51) Int. Cl.
*A47G 33/06* (2006.01)

(52) U.S. Cl.
CPC ..... *A47G 33/06* (2013.01)

(58) Field of Classification Search
CPC ..... A47G 33/06
See application file for complete search history.

(56) References Cited

U.S. PATENT DOCUMENTS

| | | | | |
|---|---|---|---|---|
| 2,826,846 | A | 3/1958 | Warren | |
| 3,655,156 | A | 4/1972 | Petrie | |
| 4,109,036 | A | 8/1978 | Lloyd | |
| 5,409,745 | A | 4/1995 | McGuire | |
| 5,550,720 | A * | 8/1996 | Carroll | A47G 33/06 362/123 |
| 5,939,154 | A | 8/1999 | Gonzalez | |
| 6,057,010 | A | 5/2000 | Ayers | |
| 6,818,264 | B1 | 11/2004 | Samperisi, Jr. | |
| D571,251 | S | 6/2008 | Rosas | |
| 7,445,824 | B2 | 11/2008 | Leung | |
| D664,469 | S | 7/2012 | Warnack | |
| 8,480,256 | B2 | 7/2013 | Hollinger | |
| 8,916,242 | B2 | 12/2014 | Fu | |
| 2010/0044545 | A1 | 2/2010 | Hackney | |
| 2010/0072747 | A1 | 3/2010 | Krize | |
| 2013/0301245 | A1 | 11/2013 | Chen | |

FOREIGN PATENT DOCUMENTS

| | | | |
|---|---|---|---|
| CA | 2258276 | A1 | 7/2000 |

OTHER PUBLICATIONS

SpecificLove, "PVC Base for Rubber Band Machine Gun" 2015, p. 1-5; Accessed at http://www.instructables.com/id/PVC-BASE-for-Rubber-Band-Machine-Gun/. Photograph labels and page numbers added by Examiner.*

* cited by examiner

*Primary Examiner* — Mark Ruthkosky
*Assistant Examiner* — Julia L Rummel

(57) ABSTRACT

The adjustable Christmas tree is an artificial Christmas tree that is adapted to fit in the corner of a room. The height of the adjustable Christmas tree can be changed to adapt to the height of the room. The adjustable Christmas tree comprises an angled base, a plurality of extension poles, a plurality of couplers, and a plurality of branches.

7 Claims, 7 Drawing Sheets

ADJUSTABLE CHRISTMAS TREE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of Christmas trees and Christmas tree design, more specifically, an artificial Christmas tree that is configured for use in a corner location.

SUMMARY OF INVENTION

The adjustable Christmas tree is an artificial Christmas tree that is adapted to fit in the corner of a room. The height of the adjustable Christmas tree can be changed to adapt to the height of the room.

These together with additional objects, features and advantages of the adjustable Christmas tree will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable Christmas tree in detail, it is to be understood that the adjustable Christmas tree is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable Christmas tree.

It is therefore important that the claims be regarded as including such equivalent construction insofar as they do not depart from the spirit and scope of the adjustable Christmas tree. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
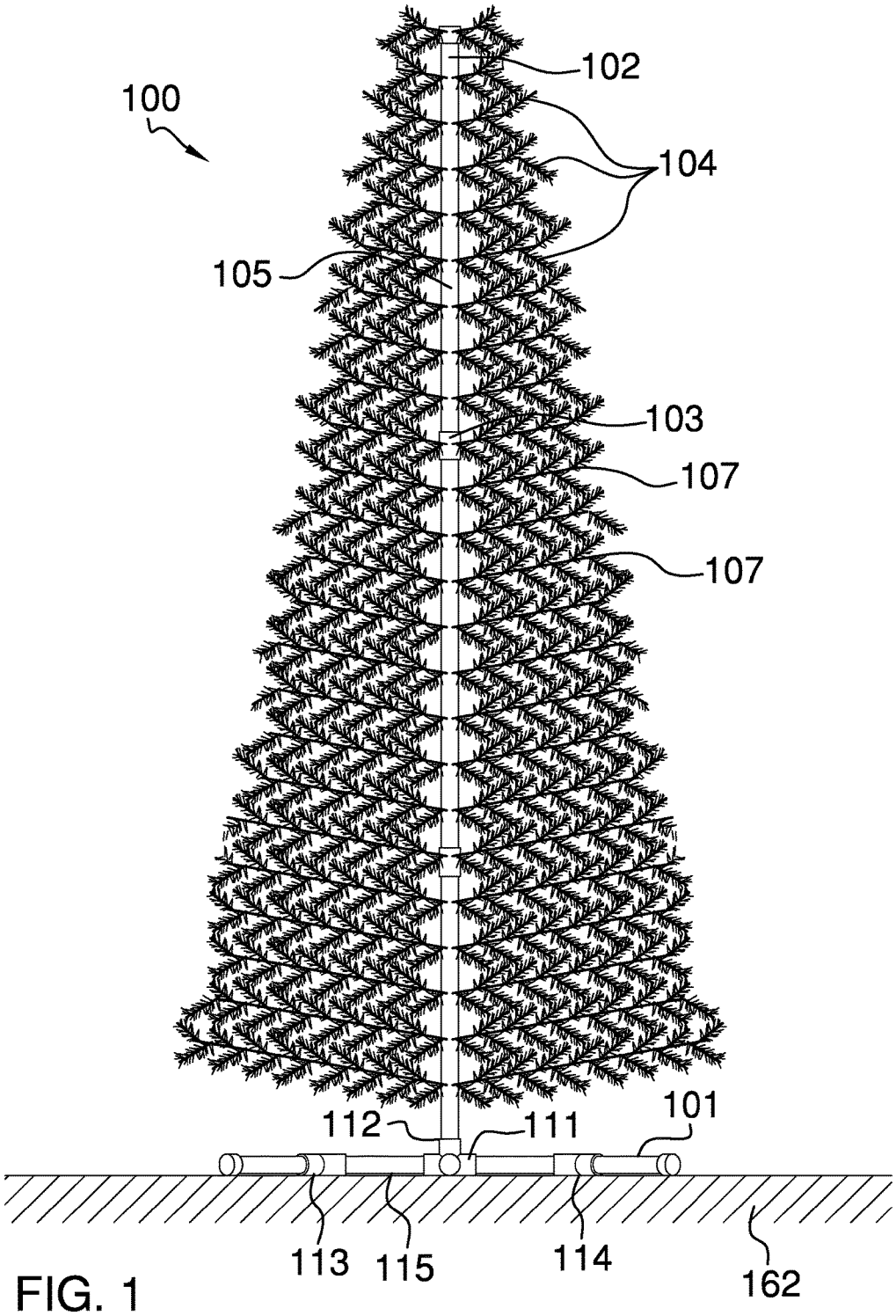
FIG. 1 is a perspective view of an embodiment of the disclosure.
Figure 2:
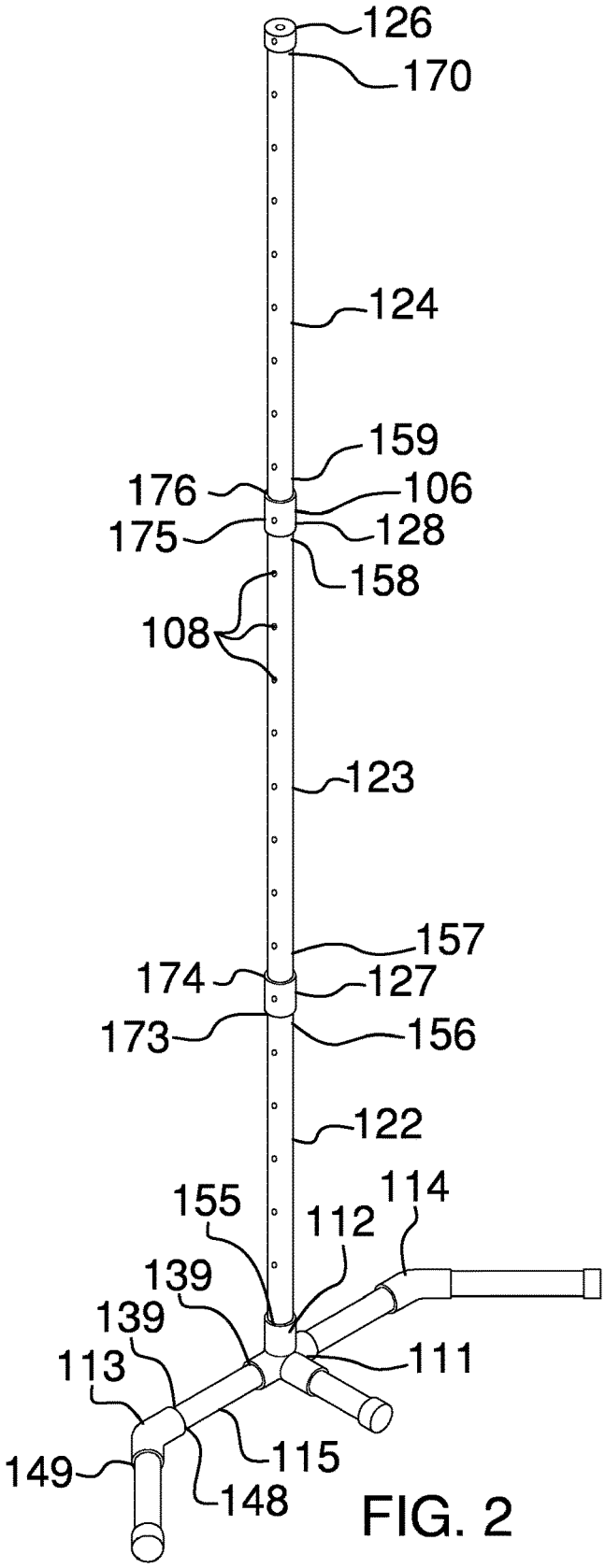
FIG. 2 is a detailed perspective view of an embodiment of the disclosure.
Figure 3:
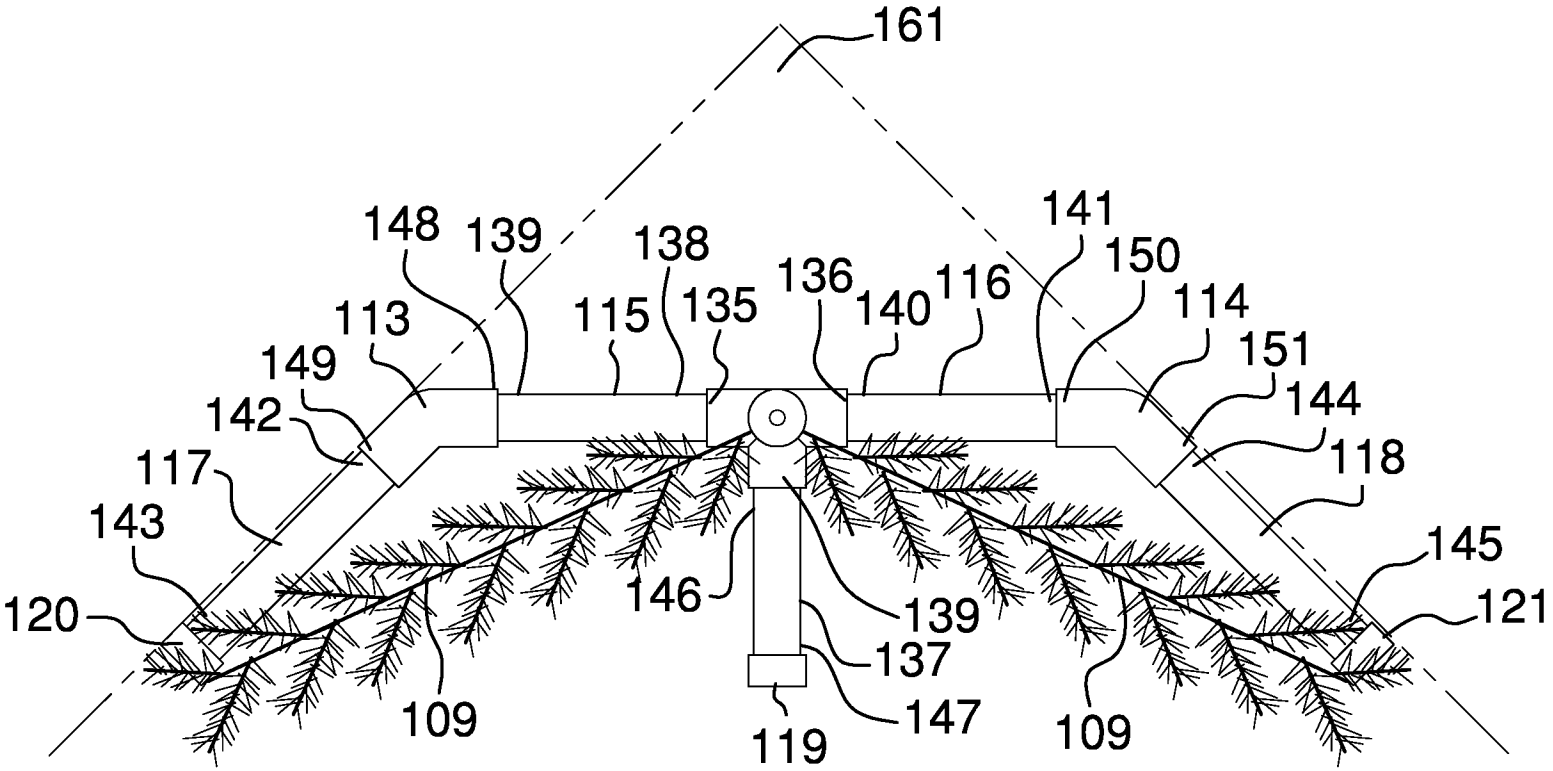
FIG. 3 is a top view of an embodiment of the disclosure.
Figure 4:
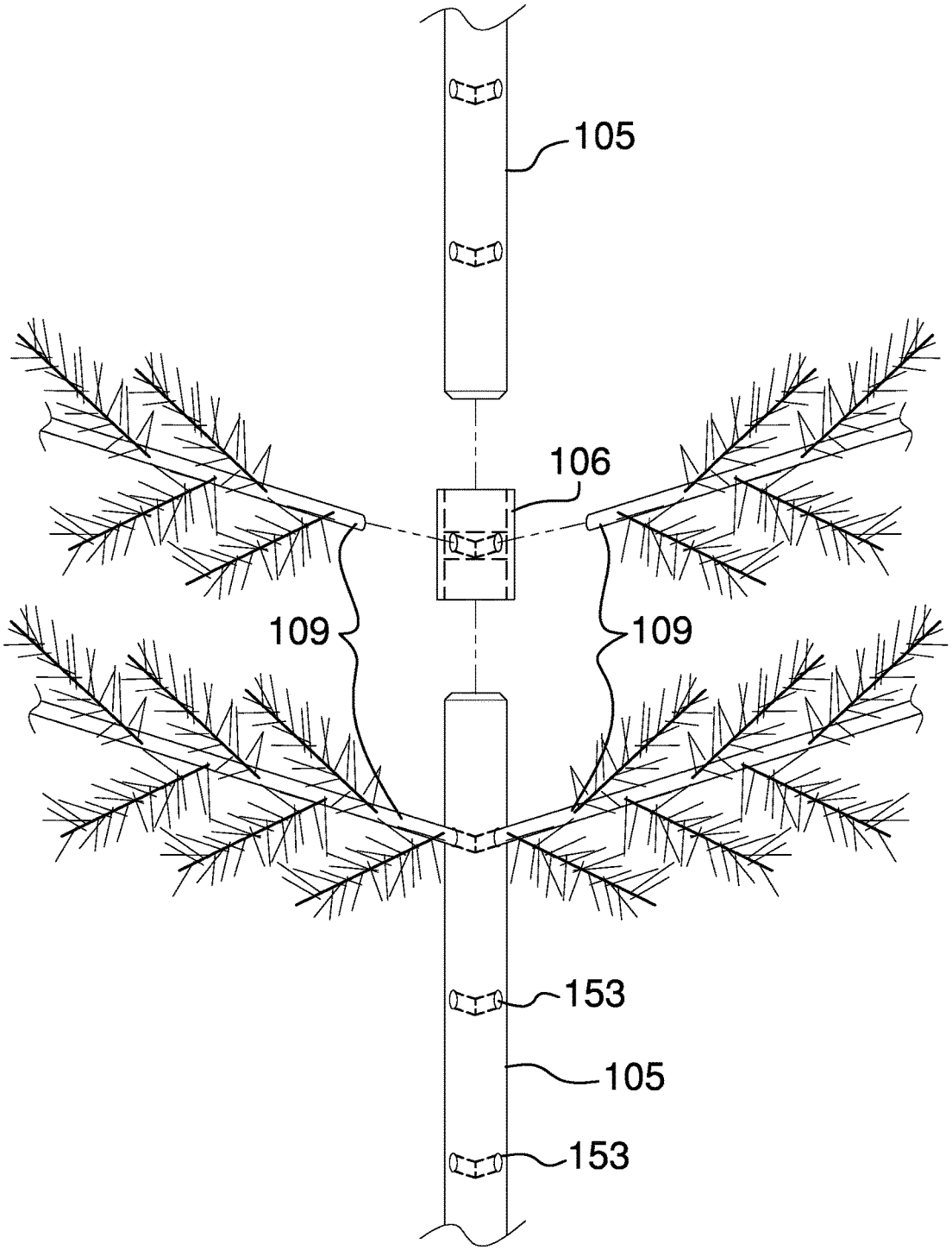
FIG. 4 is an exploded view of an embodiment of the disclosure.
Figure 5:
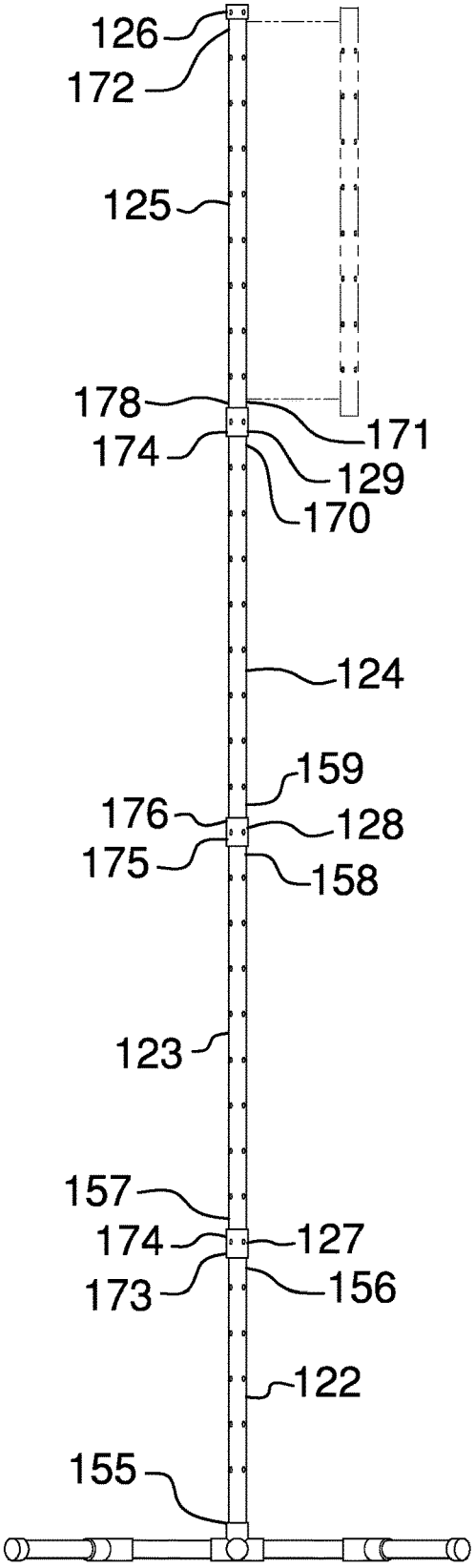
FIG. 5 is a front view of an alternative embodiment of the disclosure.
Figure 6:
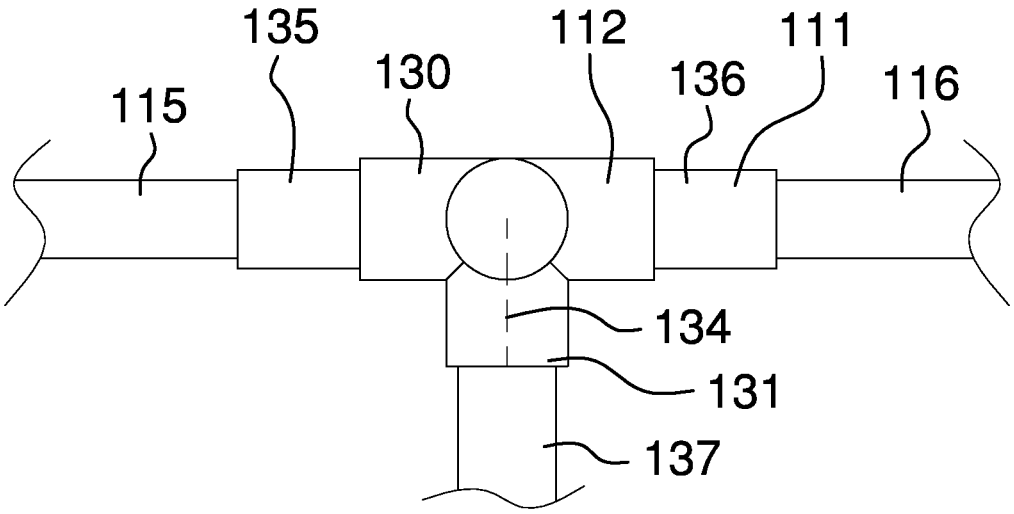
FIG. 6 is a detail view of an embodiment of the disclosure.
Figure 7:
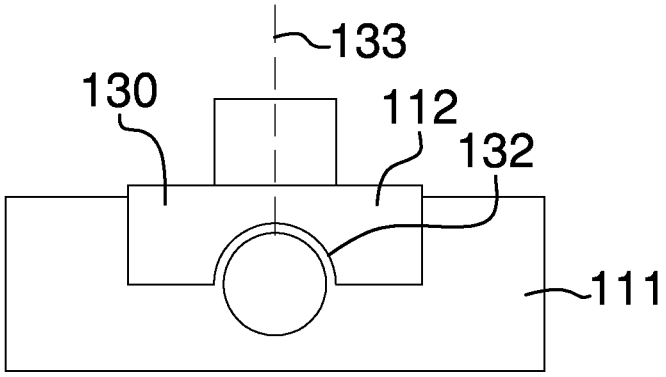
FIG. 7 is a detail view of an embodiment of the disclosure.
Figure 8:
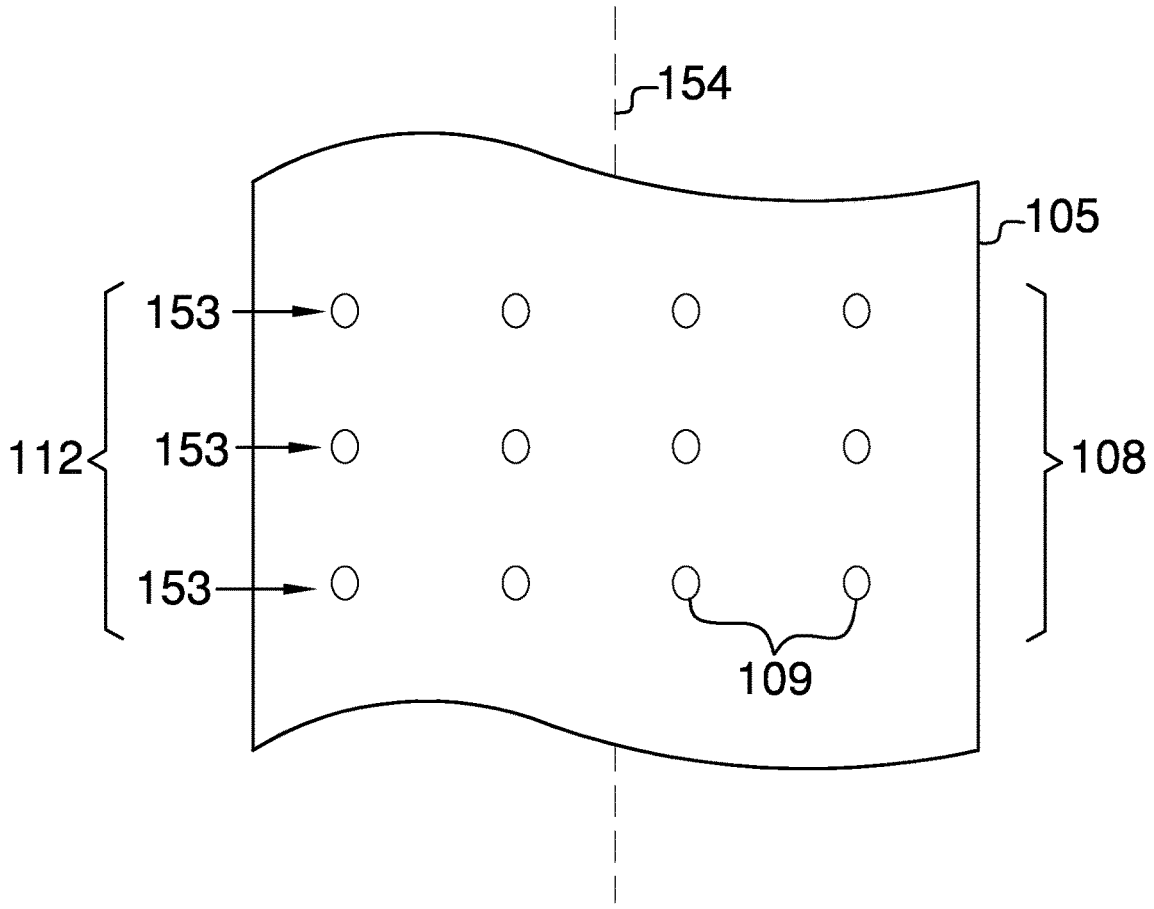
FIG. 8 is a detail view of an alternative embodiment of the disclosure.

Detailed reference will now be made to a first embodiment of the disclosure, which is illustrated in FIGS. 1 through 8.

The adjustable Christmas tree comprises 100 (hereinafter invention) an angled base 101, a plurality of extension poles 102, a plurality of couplers 103, and a plurality of branches 104. The angled base 101 is the support structure that sits on the ground 162 and acts as the base of the invention 100. The angled base 101 is designed, and intended to easily fit into a room corner 161. The plurality of extension poles 102 are used to provide height to the invention 100. Each individual extension pole 105 extends in a direction perpendicular to the ground 162. The overall height of the invention 100 can be adjusted through the addition or removal of an individual extension pole 105 to the invention 100. Each individual extension pole 105 is attached to each other using a plurality of couplers 103. The number of individual couplers 106 selected from the plurality of couplers 103 used in the assembly of the invention 100 will be one less than the number of individual extension poles 105 selected from the plurality of extension poles 102 that are used in the assembly of the invention 100.

The angled base 101 further comprises a first 90 degree tee 111, a second saddle tee 112, a second 45 degree elbow 113, a third 45 degree elbow 114, a fifth pipe 115, a sixth pipe 116, a seventh pipe 117, an eighth pipe 118, a ninth 137, a first cap 119, a second cap 120, and a third cap 121.

This paragraph and the two following paragraphs describe how the angled base 101 is assembled. The first 90 degree tee 111 is a readily and commercially available three port plumbing fitting. The first 90 degree tee 111 is further defined with a first perpendicular tee port 131, a second port 135 and a third port 136. The first perpendicular tee port 131 is identified as the port of the first 90 degree tee 111 that is perpendicular to the second port 135 and the third port 136. The second saddle tee 112 is a readily and commercially available saddle tee. The second saddle tee 112 is further defined with a first saddle tee port 130. The second saddle tee 112 is placed over the first 90 degree tee 111 such that a first center axis 133 of the first saddle tee port 130 is perpendicular to a second center axis 134 of the first perpendicular tee port 131. In order to fit around the first perpendicular tee port 131 the second saddle tee 112 is modified by forming a first fitting arc 132. The first fitting arc 132 can be cut into the second saddle tee 112 using commonly available cutting tools.

The fifth pipe 115, the sixth pipe 116, the seventh pipe 117, the eighth pipe 118, and the ninth 137 are readily and commercially available pipes used in plumbing applications. The fifth pipe 115 is further defined with a first end 138 and a second end 139. The sixth pipe 116 is further defined with a third end 140 and a fourth end 141. The seventh pipe 117 is further defined with a fifth end 142 and a sixth end 143. The eighth pipe 118 is further defined with a seventh end 144 and an eighth end 145. The ninth pipe 137 is further defined with a ninth end 146 and a tenth end 147. The second 45 degree elbow 113 and the third 45 degree elbow 114 are readily and commercially available fittings used in plumbing applications. The second 45 degree elbow 113 is further defined with a fourth port 148 and a fifth port 149. The third 45 degree elbow 114 is further defined with a sixth port 150 and a seventh port 151. The first cap 119, second cap 120, and third cap 121 are readily and commercially available fittings used in plumbing applications. The second 45 degree elbow 113, the third 45 degree elbow 114, the second port 135, the third port 136, the first perpendicular tee port 131, first cap 119, second cap 120, and second cap 121 are all sized to receive the fifth pipe 115, sixth pipe 116, seventh pipe 117, eighth pipe 118 and the ninth 137.

The final assembly of the angled base 101 is a follows. The final assembly of the angled base 101 is completed as follows. The first end 138 of the fifth pipe 115 is inserted into the second port 135. The third end 140 of the sixth pipe 116 is inserted into the third port 136. The ninth end 146 of the ninth 137 is inserted into the first perpendicular tee port 131. The second end 139 of the fifth pipe 115 is inserted into the fourth port 148 of the second 45 degree elbow 113. The fourth end 141 of the sixth pipe 116 is inserted into the sixth port 150 of the third 45 degree elbow 114. The fifth end 142 of the seventh pipe 117 is inserted into the fifth port 149 of the second 45 degree elbow 113. The seventh end 144 of the eighth pipe 118 is inserted into the seventh port 151 of the third 45 degree elbow 114. The tenth end 147 of the ninth 137 is inserted into the first cap 119. The sixth end 143 of the seventh pipe 117 is inserted into the second cap 120. The eighth end 145 is inserted into the second cap 121.

Each individual extension pole 105 selected from the plurality of extension poles 102 is a readily and commercially available pipe used in plumbing applications. Each individual extension pole 105 is further formed with a plurality of branch holes 108. Each of the individual branch holes 109 contained in the plurality of branch holes 108 are organized into a plurality of hole sets 152. Each individual hole set 153 selected from the plurality of hole sets 152 comprises a collection of between two and five individual branch holes 109. Each of the individual branch holes 109 contained in any given individual hole set 153 form a line that is perpendicular to the direction of a third center axis 154 of the individual extension pole 105. Each individual branch hole 109 is sized to receive an individual branch 107 selected from the plurality of branches 104. The individual branches 107 and the plurality of branches 104 are discussed elsewhere in this disclosure.

Each individual coupler 106 selected from the plurality of couplers 103 is a readily and commercially available fitting used in plumbing applications. Each individual coupler 106 is sized to receive any individual extension pole 105 selected from the plurality of extension poles 102. The purpose of each individual coupler 106 is to join two individual extension poles 105 to each other by inserting an end of each individual extension poles 105 into ports associated with each individual coupler 106.

In the first embodiment of the disclosure, the plurality of extension poles 102 further comprises a first extension pole 122, a second extension pole 123, a third extension pole 124 and a fourth extension pole 125. The first extension pole 122 is further defined by an eleventh end 155 and a twelfth end 156. The second extension pole 123 is further defined by a thirteenth end 157 and a fourteenth end 158. The third extension pole 124 is further defined by a fifteenth end 159 and a sixteenth end 170. The fourth extension pole 125 is further defined by a seventeenth end 171 and an eighteenth end 172. The plurality of couplers 103 further comprises a first coupler 127, a second coupler 128, and a third coupler 129. The first coupler 127 is further defined with an eighth port 173 and a ninth port 174. The second coupler 128 is further defined with a tenth port 175 and an eleventh port 176. The third coupler 129 is further defined with a twelfth port 177 and a thirteenth port 178. To assemble the plurality of extension poles 102 the eleventh end 155 of the first extension pole 122 is inserted into the first saddle tee port 130. The twelfth end 156 of the first extension pole 122 is inserted into the eighth port 173 of the first coupler 127. The thirteenth end 157 of the second extension pole 123 is inserted into the ninth port 174 of the first coupler 127. The fourteenth end 158 of the second extension pole 123 is inserted into the tenth 175 port of the second coupler 128. The fifteenth end 159 of the third extension pole 124 is inserted into the eleventh port 176 of the second coupler 128. The sixteenth end 170 of the third extension pole 124 is inserted into the twelfth port 177 of the third coupler 129. The seventeenth end 171 of the fourth extension pole 125 is inserted into the thirteenth port 178 of the third coupler 129. The eighteenth end 172 of the fourth extension pole 125 is inserted into a fourth cap 126. The fourth cap 126 is a readily and commercially available fitting used in plumbing applications. The fourth cap 126 is sized to receive the eighteenth end 172 of the fourth extension pole 125.

The first embodiment of the disclosure represents the maximum height achievable by the first embodiment of the disclosure. To reduce the height of the first embodiment of the disclosure, the fourth extension pole 125 and the third coupler 129 are removed and the fourth cap 126 is placed on the sixteenth end 170 of the third extension pole 124. This is shown most clearly in FIG. 5.

The invention 100 has associated with it a plurality of branches 104. In the first embodiment of the disclosure, each individual branch 107 associated with the plurality of branches 104 is a commercially available branch from an artificial Christmas tree. Depending on the design, the individual branch 107 may or may not include Christmas lights. To complete the assembly of the invention 100, each individual branch 107 contained in the plurality of branches 104 is inserted into an individual branch hole 109 selected from the plurality of branch holes 108. If the individual branch 107 is designed with lights, methods to electrically wire and operate the lights associated with the individual branch 107 are well known and documented in the art.

In the first embodiment of the disclosure, the use of PVC pipes and fittings for the angled base 101, the plurality of extension poles 102 and the plurality of couplers 103 is preferred.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An artificial Christmas tree comprising a base, a plurality of extension poles, a plurality of couplers, and a plurality of branches;

wherein the artificial Christmas tree is vertically adjustable;

wherein the base allows the artificial Christmas tree to be positioned in a corner;

wherein the base comprises a first 90 degree tee, a second saddle tee, a second 45 degree elbow, a third 45 degree elbow, a fifth pipe, a sixth pipe, a seventh pipe, an eighth pipe, a ninth pipe, a first cap, a second cap, and an third cap;

wherein the first 90 degree tee is further defined with a first perpendicular tee port, a second port and a third port;

wherein the second saddle tee is further defined with a first saddle tee port;

wherein the second saddle tee is placed over the first 90 degree tee;

wherein the fifth pipe is further defined with a first end and a second end;

wherein the sixth pipe is further defined with a third end and a fourth end;

wherein the seventh pipe is further defined with a fifth end and a sixth end;

wherein the eighth pipe is further defined with a seventh end and a eighth end;

wherein the ninth pipe is further defined with a ninth end and a tenth end;

wherein the second 45 degree elbow is further defined with a fourth port and a fifth port;

wherein the third 45 degree elbow is further defined with a sixth port and a seventh port;

wherein the first end of the fifth pipe is inserted into the second port;

wherein the third end of the sixth pipe is inserted into the third port;

wherein the ninth end of the ninth pipe is inserted into the first perpendicular tee port;

wherein the second end of the fifth pipe is inserted into the fourth port of the second 45 degree elbow;

wherein the fourth end of the sixth pipe is inserted into the sixth port of the third 45 degree elbow;

wherein the fifth end of the seventh pipe is inserted into the fifth port of the second 45 degree elbow;

wherein the seventh end of the eighth pipe is inserted into the seventh port of the third 45 degree elbow;

wherein the tenth end of the ninth pipe is inserted into the first cap;

wherein the sixth end of the seventh pipe is inserted into the second cap;

wherein the eighth end is inserted into the second cap;

wherein the plurality of extension poles comprises a collection of individual extension poles;

wherein each individual extension pole is further formed with a plurality of branch holes;

wherein a branch selected from the plurality of branches is attached to an individual extension pole by inserting the selected branch into a hole selected from the plurality of branch holes.

2. The artificial Christmas tree according to claim 1 wherein the plurality of couplers comprises a collection of individual couplers;

wherein each individual coupler is sized to receive any individual extension pole selected from the plurality of extension poles;

wherein each individual coupler joins two individual extension poles to each other.

3. The artificial Christmas tree according to claim 2 wherein the plurality of extension poles further comprises a first extension pole, a second extension pole, a third extension pole and a fourth extension pole;

wherein the first extension pole is further defined by a eleventh end and a twelfth end;

wherein the second extension pole is further defined by a thirteenth end and a fourteenth end;

wherein the third extension pole is further defined by a fifteenth end and a sixteenth end;

wherein the fourth extension pole is further defined by a seventeenth end and a eighteenth end.

4. The artificial Christmas tree according to claim 3 wherein the plurality of couplers further comprises a first coupler, an second coupler, and a third coupler;

wherein the first coupler is further defined with an eighth port and a ninth port;

wherein the second coupler is further defined with a tenth port and an eleventh port;

wherein the third coupler is further defined with a twelfth port and a thirteenth port.

5. The artificial Christmas tree according to claim 4 wherein the twelfth end of the first extension pole is inserted into the eighth port of the first coupler;

wherein the thirteenth end of the second extension pole is inserted into the ninth port of the first coupler;

wherein the fourteenth end of the second extension pole is inserted into the tenth port of the second coupler;

wherein the fifteenth end of the third extension pole is inserted into the eleventh port of the second coupler.

6. The artificial Christmas tree according to claim 5 wherein the sixteenth end of the third extension pole is inserted into a fourth cap.

7. The artificial Christmas tree according to claim 5 wherein the sixteenth end of the third extension pole is inserted into the twelfth port of the third coupler;

wherein the seventeenth end of the fourth extension pole is inserted into the thirteenth port of the third coupler;

wherein the eighteenth end of the fourth extension pole is inserted into a fourth cap.

* * * * *